US005426445A

United States Patent [19]

Prouty et al.

[11] Patent Number: 5,426,445

[45] Date of Patent: Jun. 20, 1995

[54] SYNCHRONOUS CLEAR FOR CRT MEMORY BUFFER

[75] Inventors: Bryan G. Prouty; Charles R. Dowdell, both of Ft. Collins, Colo.

[73] Assignee: Hewlett-Packard Company, Palo Alto, Calif.

[21] Appl. No.: 201,500

[22] Filed: Feb. 24, 1994

[51] Int. Cl.[6] ..... G09G 1/02

[52] U.S. Cl. ..... 345/28; 345/200

[58] Field of Search ..... 345/189–191, 345/193, 200, 27, 28

[56] References Cited

U.S. PATENT DOCUMENTS

| | | | |
|---|---|---|---|
| 4,511,965 | 4/1985 | Rajaram | 345/200 |
| 4,782,462 | 11/1988 | Kaplinsky | 345/190 |
| 4,868,556 | 9/1989 | Murakami et al. | 345/200 |

*Primary Examiner*—Jeffery Brier

[57] ABSTRACT

A system that clears a portion of a graphics display in synchronization with an electron beam scanning the face of the graphics display. When a clear operation for a window on the graphics display screen is received, the system compares the location of the beam with the window and determines whether an interference would occur if the window is cleared immediately. If no interference would occur, the window clear operation is immediately started. If an interference would occur, the system waits until the electron beam has scanned beyond the top of the window before starting the clear operation. Then, before clearing each scan line, the system waits until the beam has already scanned past the scan line being cleared.

15 Claims, 5 Drawing Sheets

SYNCHRONOUS CLEAR FOR CRT MEMORY BUFFER

FIELD OF THE INVENTION

This invention relates to computer systems and more particularly to graphics display devices within such computer systems. Even more particularly, the invention relates to apparatus and methods for clearing a display area of a graphics display device.

BACKGROUND OF THE INVENTION

Cathode ray tube (CRT) display technology used today in computers and terminals is primarily raster-scan technology, similar to television sets, except that computer displays are bit mapped and have a frame buffer to hold the bits of data being displayed, whereas television sets display a received signal in real time without storing the signal. When the display is being changed from one image to another, it is desirable that the old image be completely removed by clearing the screen, such as by setting a new background color value, before a new image is displayed on the screen. If either the clear or redraw operations occur during the vertical active time of the display, undesirable "flashing" or "tearing" occurs on the screen. This undesirable effect is not very noticeable when the exchange of images does not occur very often. However, when the exchange of images is very frequent, such as with today's fast 3D display systems, or with multi-media displays wherein a moving image is displayed on the screen and may change frames as often as thirty times per second, the effect of flashing or tearing becomes extremely distracting.

Prior art systems typically wait to start the clearing operation until the raster-scanning electron beam performs a vertical retrace operation. By waiting until vertical retrace starts, the clearing operation will not occur during the active data display time, thus, preventing the flashing or tearing. This has the undesirable effect of delaying each clear until a vertical retrace occurs.

The clearing problem is less severe in systems that have multiple frame buffers attached to the CRT. In this type of system, a new image can be placed in a second frame buffer while a first frame buffer is being displayed. To exchange the images, the CRT simply has to switch from displaying the first frame buffer to displaying the second frame buffer. However, to prevent flashing or tearing, the switching of displaying information from the first buffer to the second buffer must also occur during a vertical retrace. In a window environment, such as with the X window system of the UNIX (tm) operating system, switching must occur on a window basis, rather than on a screen basis.

It is apparent that prior art systems are spending considerable time waiting for vertical retrace to occur before clearing the frame buffer that displays images on a CRT. For example, for a CRT that displays at a 60 Hz rate, each screen scan requires approximately 16 milliseconds. Since a screen clear could be initiated while the beam is scanning at any location on the CRT, on average, the CPU will have to wait for the beam to traverse half the CRT, or approximately 8 milliseconds for a CRT scanning at 60 Hz. Increasingly, monitors scan at 72 Hz, however, this still requires a wait of almost 7 milliseconds.

It is thus apparent that there is need in the art for a system to reduce the amount of time that a CPU spends waiting for a vertical retrace operation to occur in a raster-scan CRT display system before clearing the frame buffer. The present invention meets this and other needs in the art.

SUMMARY OF THE INVENTION

It is an aspect of the present invention to provide a clear operation for a raster-scan CRT that is synchronized with the scanning electron beam.

It is another aspect of the invention to monitor the beam position in order to determine whether the clear operation must follow the beam.

Still another aspect of the invention is to prevent two successive clears during a single vertical scan of the beam.

The above and other aspects of the invention are accomplished in a windowed or full-screen system that detects the position of the electron beam scanning the face of the CRT when a clear operation is received. The system compares the location of the beam with the window to be cleared and determines whether an interference would occur if the window is cleared immediately. If no interference would occur, the window clear operation is immediately started. If an interference would occur, the system waits until the electron beam has scanned beyond the top of the window before starting the clear operation. Then, before clearing each scan line, the system waits until the beam has already scanned past the scan line being cleared.

If the window being cleared is very small, it is possible that the window can be cleared, a new image displayed in the window, and a second clear operation be received prior to the beam having completed a scan of the CRT to display the new image. In this event, the system provides a flag wherein the user can prevent the subsequent clear operation until the image has been displayed at least once. Because this behavior may or may not be desirable in the system, this flag may be enabled or disabled.

In determining whether an interference would occur, the system also provides for an uncertainty, or guard, area above the window being cleared, to allow for tolerance in the location of the scanning electron beam. If the beam is above the guard area at the start of the clear, the beam position is ignored during the clear. If the beam is below the guard area, the clearing follows the beam.

When double buffering, only the setting of the attribute bits is required to be synchronized to prevent tearing. However, the present invention also provides for the alternate buffer clear to be synchronized. This further enhances performance by accomplishing the buffer clear during the time between the end of a scan line clear and the completion of the beam traversing the screen.

BRIEF DESCRIPTION OF THE DRAWINGS

The above and other aspects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
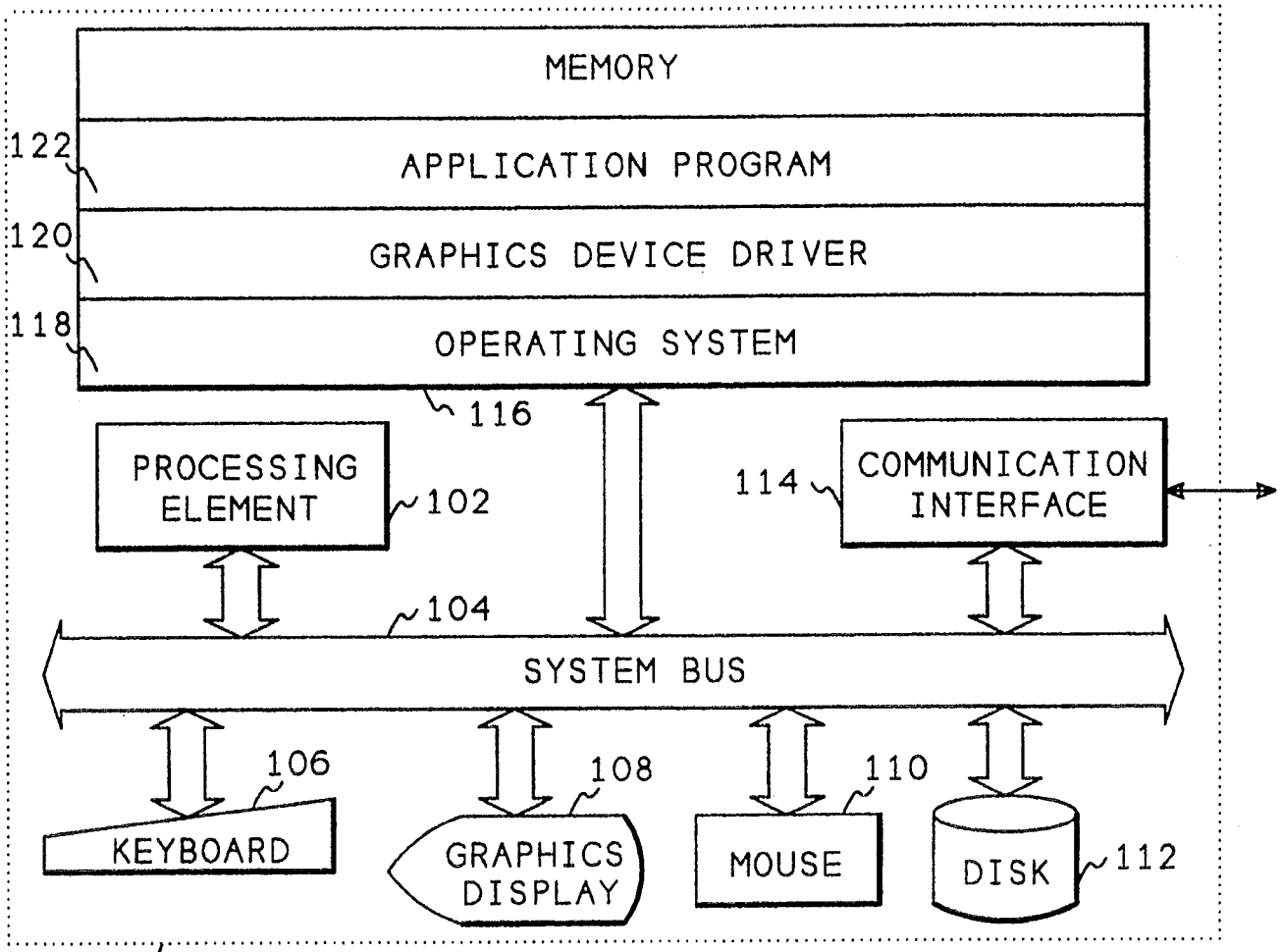
FIG. 1 shows a block diagram of a computer system incorporating the present invention.

FIG. 1 shows a block diagram of a computer system containing the present invention. Referring now to FIG. 1, the computer system 100 contains a processing element 102 which communicates to other elements of the computer system 100 over a system bus 104. A keyboard 106 allows text input to the computer system 100 and a mouse 110 allows graphical locator input to the computer system 100. A graphics display 108 provides for graphics and text output to be viewed by a user of the computer system 100, and contains the beam-following clear system of the present invention. A disk 112 stores an operating system and other user data of the computer system 100.

A memory 116 contains an operating system 118, graphics driver software 120, and an application program 122. Those skilled in the art will recognize that the operating system 118 could be one of many different operating systems, including many windows-type operating systems, and that many application programs could be performing in a multi-tasking operating system.

Figure 2:
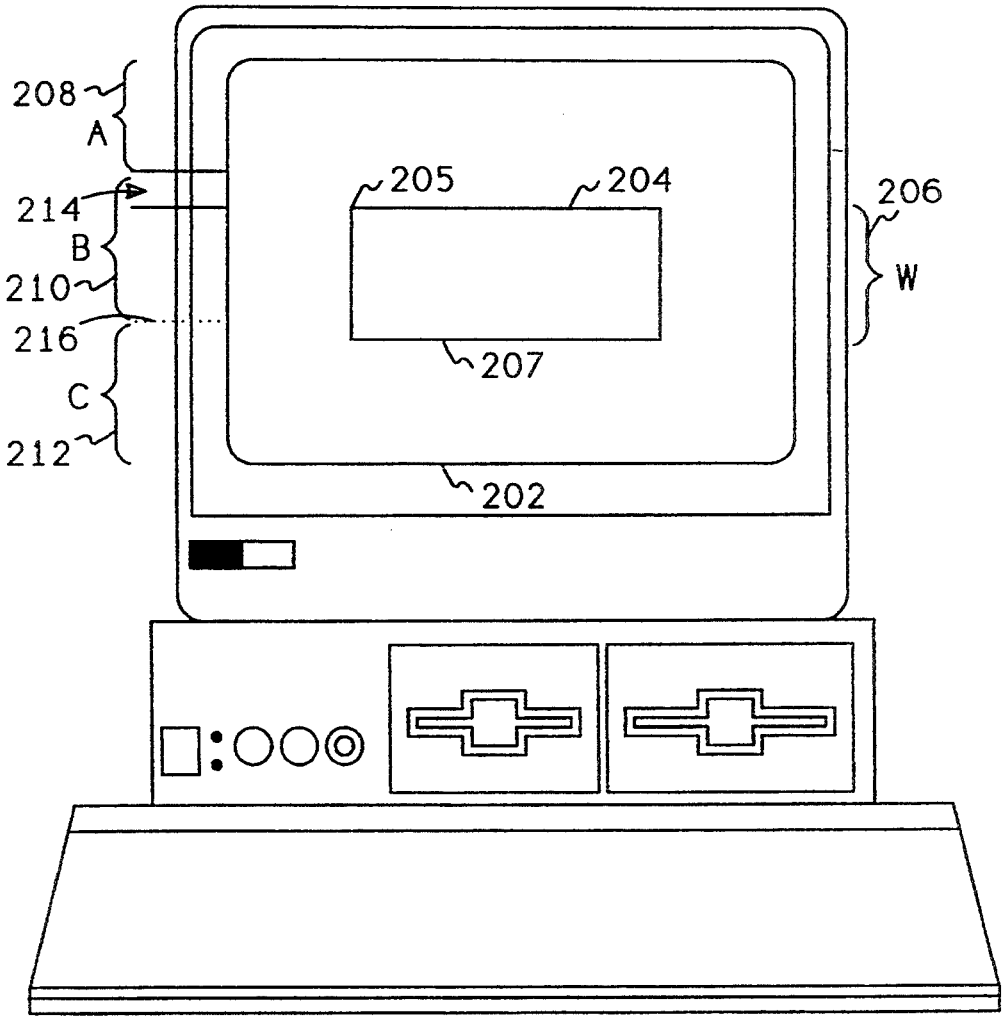
FIG. 2 shows a screen of a graphics display device and illustrates how the present invention synchronously clears the memory buffer.

FIG. 2 shows a screen of the graphics display device 108 (FIG. 1) and illustrates how the present invention synchronously clears the frame buffer used to display information on the graphics display 108. The purpose of the beam-following synchronous screen clear system of the present invention is to improve screen clear time whenever graphics rendering of geometry or images is synchronized with the vertical retrace of the display monitor within the graphics display 108. As discussed in the background of the invention, if the clearing and rendering operations are not synchronized to the display monitor, flashing or tearing can occur. Also, the faster the screen clear, the more time is saved in the processor driving the display. Unlike prior art systems, the present invention synchronizes the clear operation without having to wait for a vertical retrace.

Referring now to FIG. 2, a graphics screen 202, displayed on a graphics monitor contained within the graphics display system 108 (FIG. 1), contains a typical area 204 which will be cleared with a clear operation. The area 204 might typically be a window within a windows-type operating system, or it might be any other area on the screen 202. Although the area 204 is shown as a rectangular area, the invention is not so limited. Those skilled in the art will recognize that the invention will work to clear any area of a screen.

When the graphics display 108 receives a clear command for the area 204 from the graphics device driver 120 (FIG. 1), it receives the location of the upper left corner 205, along with the length of the area to be cleared in both the X and Y directions. In FIG. 2, the X direction is the horizontal direction extending from the location 205 toward the right hand side of the screen, and the Y direction is the vertical direction extending from the location 205 downward in FIG. 2. The area W 206 represents the length in scan lines of the area to be cleared. Thus, when the graphics display 108 receives the clear command, it knows the starting scan line where the clear is to start, and the number of scan lines to clear.

The invention then determines which line on the graphics monitor is currently being scanned by the electron beam, in a manner which will be described below. If the electron beam is scanning within the area A 208, the clearing of the area 204 can proceed without concern for the scanning electron beam. This is because the amount of time necessary to clear one scan line of data in a frame buffer used to display information on the screen 202 is faster than the time necessary for the electron beam to display one scan line of frame buffer data on the screen 202. Therefore, if the electron beam is scanning in area A 208, well above the area 204, the clear can proceed without concern for the electron beam because the entire area 204 will be cleared in the frame buffer before the electron beam can catch up to the scan lines being cleared.

Although the entire area 204 will be cleared ahead of the beam, this does not necessarily mean that the beam may not start displaying lines from the beginning of the area 204 while the end sections of the area 204 are still being cleared in the frame buffer. This will not cause a problem, however, since the electron beam will always be scanning and displaying data already cleared in the frame buffer.

Likewise, if the electron beam is scanning within the area C 212, that is, below the area 204, the clear operation will not interfere with the electron beam, since the electron beam is already scanning below the area 204 or will be below the area 204 before the clearing operation reaches the bottom of the area 204. That is, the clear operation will not catch up to the electron beam if it is below the line 216, which is located at the start of C 212.

As illustrated in FIG. 2, the line 216 is not the bottom of the area 204, but is some distance above the bottom line 207 of the area 204. As described above, the clearing operation is faster than the scanning electron beam, however, it is not instantaneous. Therefore, if the scanning beam is below the line 216, and the clearing operation starts at the corner 205, even though the clearing operation is faster than the scan, it will not catch up to the scanning beam before the scanning beam drops below the line 207. The actual location of the line 216 is dependent on the size of the window 204, specifically the height W 206 of the window 204, and the speed of the clear operation, as well as the speed of the scanning electron beam. This makes the line 216 dependent upon the particular monitor type being used and the frequency of the scanning.

If the electron beam is scanning within the area B 210, interference may occur between the clearing operation and the scanning of the beam. Because of possible interference, the invention causes the clearing operation to follow the scanning of the beam, wherein a line within the frame buffer is not cleared until after the line has been scanned out by the electron beam and displayed on the display monitor.

The area B 210 consists of two areas, one between the top corner 205 and the line 216, and a second area, called the uncertainty buffer 214 above the top of the area 204. Because of tolerances in the speed of the monitor, the speed of the memory comprising the frame buffer being cleared, and the speed of the electronics within the graphics display 108, some uncertainty exists as to how close the electron beam can be scanning to the top of the area 204 without causing interference. Because of this uncertainty, the present invention provides for the uncertainty buffer 214 as a guard area above the window being cleared. This uncertainty, or guard, buffer is not typically very large. For example, in some display systems it is only four scan lines.

If the beam is scanning below the top of the area B 210 when the clear command is received, the present invention waits until the beam has scanned beyond a line before clearing the line in the frame buffer. This insures that flashing or tearing will not occur, since a line is not cleared in the frame buffer until after it has been displayed on the graphics monitor.

Figure 3:
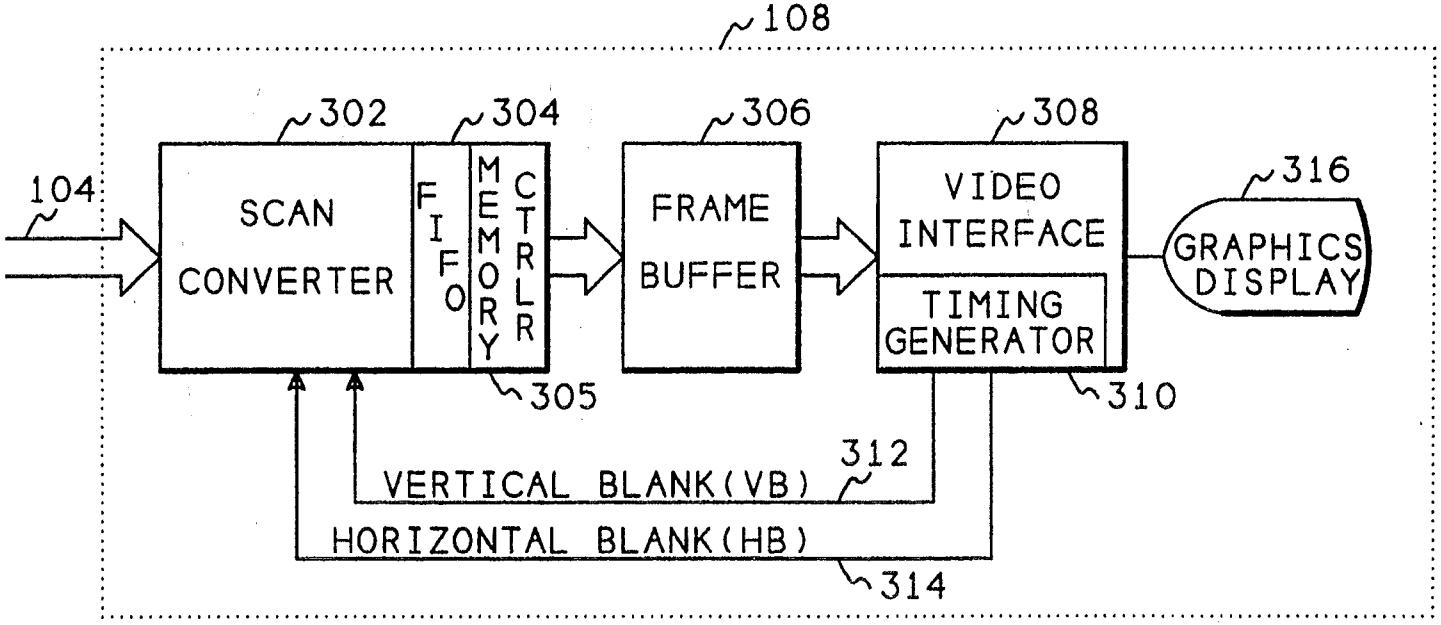
FIG. 3 shows a block diagram of the CRT drive electronics of the graphics display device of FIG. 1.

FIG. 3 shows a block diagram of the graphics display device 108 of FIG. 1. Referring now to FIG. 3, the graphics display 108 contains a scan converter 302 which converts commands received over the bus 104 from the graphics device driver 120 (FIG. 1) into rasterized data which is passed through a FIFO (First-In-First-Out) buffer 304, through a memory controller 305, and sent to a dual port RAM frame buffer 306. A video interface 308 retrieves scanned data from the frame buffer 306, and synchronizes the data to the scanning of the video display graphics monitor 316 utilizing a timing generator 310. The timing generator 310 generates the timing signals necessary to control the graphics monitor 316, and includes a vertical blank signal 312 and a horizontal blank signal 314 which are sent back to the scan converter 302 to be used by the present invention. The vertical blank signal 312 is active when the graphics monitor is performing a vertical retrace, and the horizontal blank signal 314 is active when the graphics monitor 316 is performing a horizontal retrace.

Figure 4:
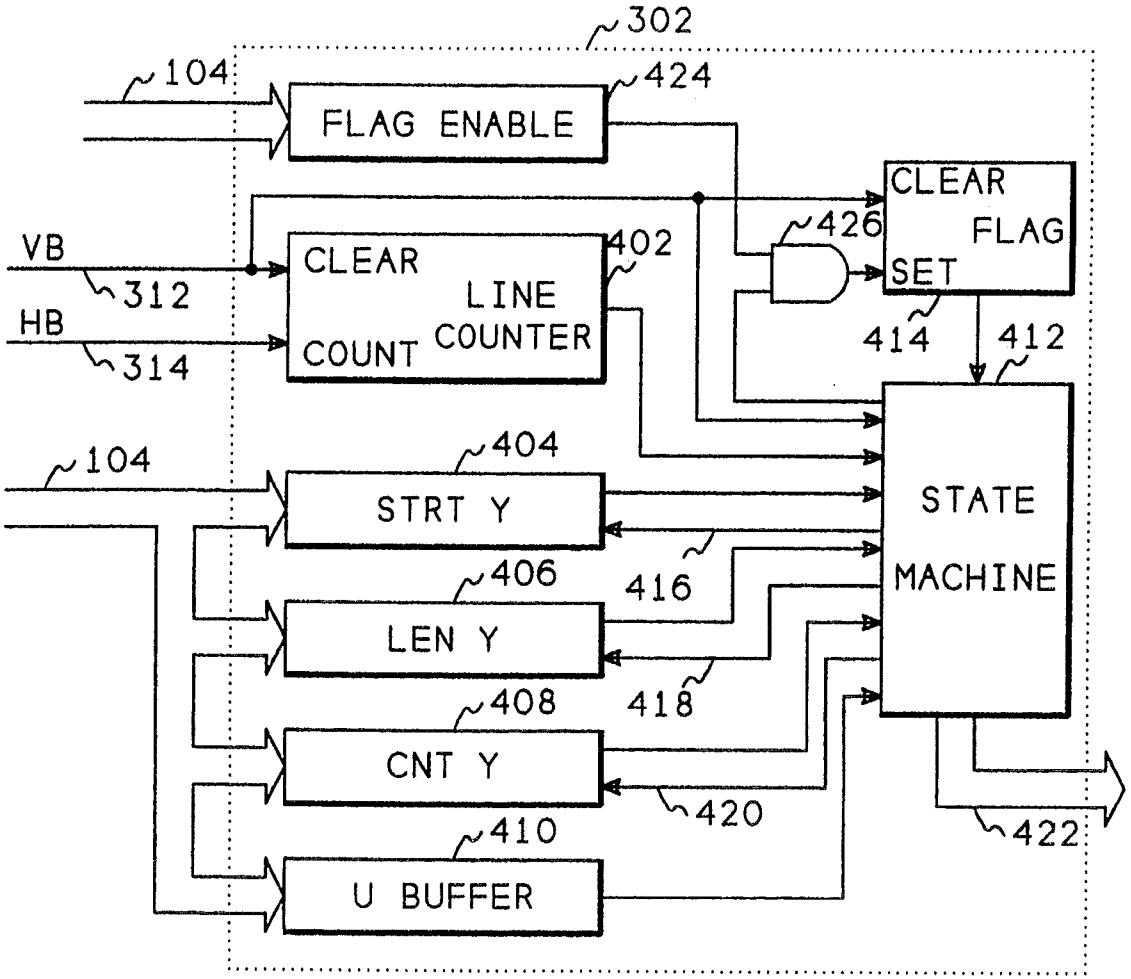
FIG. 4 shows a block diagram of the CRT drive electronics circuitry used in the synchronous clear.

FIG. 4 shows a block diagram of the portion of the scan converter 302 used to perform the synchronous clear of the present invention. Referring now to FIG. 4, a line counter 402 receives a clear signal from the vertical blank signal 312 of FIG. 3. The line counter 402 also receives a count signal from the horizontal blank signal 314 of FIG. 3. In the preferred embodiment, the clear signal and count signals are synchronized, by edge triggered devices, to the leading edge of the vertical blank and horizontal blank signals respectively. Utilizing these two signals, the line counter 402 starts with the beginning of a vertical retrace, and counts horizontal retraces to provide a count representing the scan line currently being scanned by the electron beam.

When the graphics display driver 120 (FIG. 1) desires to perform a clear operation, it sends four sets of information to the graphics display 108. The first set of information, as described above with respect to FIG. 2, is the top left location of the rectangle being cleared. That is, the X and Y locations of the top left of the rectangle, as illustrated by point 205 in FIG. 2. Although the clear operation needs both the starting X and Y locations, the synchronization of the clear requires only the Y location. Thus, this information is stored in the STRT Y register 404 of FIG. 4. The starting X location is stored elsewhere within the scan converter 302 (FIG. 3) and is used by the electronics of the scan converter 302 to clear the correct number of bits on the line. The graphics display also receives color information (not shown in FIG. 4), which is placed in the frame buffer to perform the clear. In this manner, the clear operation simply sets a background color for the CRT at the location of the window being cleared or sets an attribute bit value to effect a double buffer swap.

The second set of information sent by the graphics device driver 120 is the length in the X direction and the length in the Y direction. The length in the X direction is also not needed for the synchronization process, and is stored elsewhere in the scan converter 302. The length of the clear in the Y direction is used, and is stored in the LEN Y register 406 of FIG. 4.

The third set of information is the CNT Y register 408. This register contains a count of the number of lines scanned between the start of a vertical retrace and the beginning of the window being cleared. This will be the value stored in STRT Y plus the number of lines scanned while a vertical retrace is being performed. This counter is used to follow the beam during the clear operation.

The last set of information that the graphics device driver 120 sends to the graphics display 108 is the contents of U BUFFER, or guard, register 410. This is the scan line Y location of the top of the uncertainty buffer 214 (FIG. 2), as counted from the beginning of vertical retrace. This is the CNT Y value minus the size of the uncertainty buffer. As discussed above with respect to FIG. 2, if the graphics monitor is scanning below this line at the time the clear operation is received, then the clear operation must follow the beam.

The state machine 412, which will be illustrated below with respect to FIG. 5, synchronizes the clear operation to the location of the beam on the graphics monitor.

Figure 5:
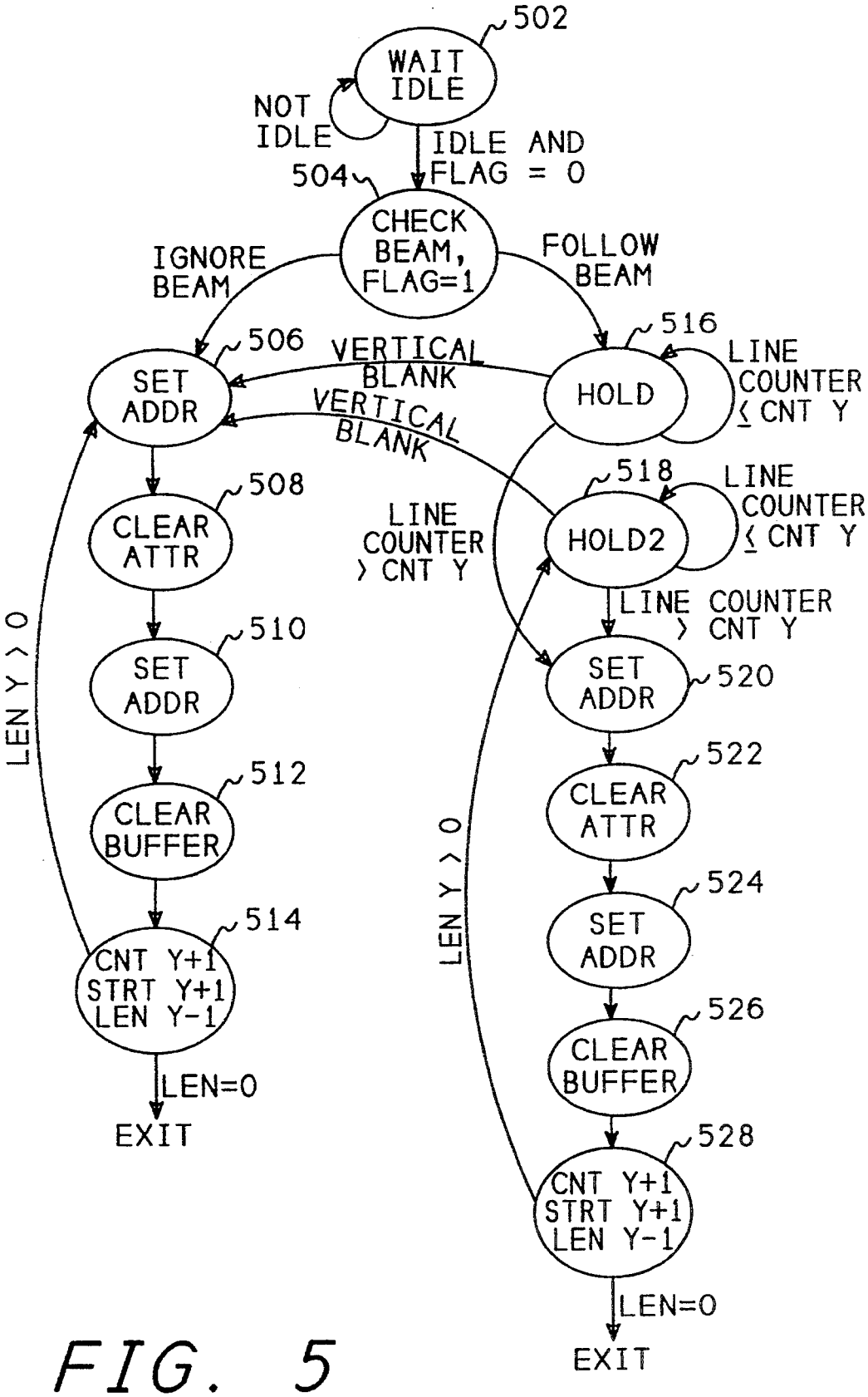
FIG. 5 shows a state diagram of the state machine of FIG. 4.

FIG. 5 shows a state diagram of the portion of the state machine 412 that causes the synchronization of the clear operation and the scanning electron beam. Referring now to FIG. 5, when a clear operation is received, the state machine is entered at state 502. The state machine will wait in this state until the FIFO 304 has completely cleared of data being sent to the frame buffer 306. By waiting until the FIFO 304 is cleared, the state machine ensures that clear commands sent to the frame buffer will be executed immediately and not held up by other commands, thus, facilitating synchronization with the electron beam.

The state machine will also wait in state 502 if a flag is set to a one. The purpose of the flag will be discussed below. When the FIFO 304 is cleared and the flag is equal to zero, the state machine goes to state 504 which checks the beam and sets the flag to one. The check beam function determines whether the scan location of the beam, as determined by line counter 402, is less than the value in the U Buffer register 410. If this is the case, then the beam can be ignored and state 504 transfers to state 506.

After the check beam determines that the beam can be ignored, state 506 sends an address to the frame buffer 306 (FIG. 3), by sending the STRT Y register 404 through the bus 422 to the FIFO 304 and the memory controller 305 into the frame buffer 306. State 508 then sends a command to the frame buffer to clear the attribute bits at the address just sent. Block 510 then sends the same STRT Y address to the frame buffer again and block 512 then clears the frame buffer at the address just sent. Clearing the line of data requires setting bits in the frame buffer to a known state, such as a defined background color for the window being cleared, as discussed above. State 514 then sends signal 416 (FIG. 4) to cause the STRT Y register 404 to increment by one, state 514 also sends signal 418 (FIG. 4) to cause the LEN Y register 406 to decrement by one, and state 514 sends signal 420 (FIG. 4) to cause the CNT Y register 408 to increment by one. If the LEN Y register 406 is greater than zero, state 514 transfers back to state 506 to clear the next line in the frame buffer. If the LEN Y register 406 has reached zero, the buffer clear operation is complete so state 514 then exits.

If the beam is currently scanning at a line located below the U Buffer value 410, the clear operation must follow the beam so block 504 transfers to block 516.

This also covers the case where the beam is below the line 216 in area C 212 (FIG. 2). Although the clear will follow the beam in the case of area C 212, the clear will never catch up with the beam, so the clear will be performed at full speed.

State 516 holds until the line counter 402 (FIG. 4) is greater than the CNT Y register 408. Once the line counter has passed the address in the CNT Y register 408, it is safe to clear the line in the frame buffer that is addressed by the CNT Y register 408. Therefore, state 516 goes to state 520 which transfers the address in the STRT Y register 404 to the frame buffer 306 (FIG. 3) and then state 522 sends a command to clear the attribute bits in the buffer at the address just sent. State 524 sends the STRT Y address to the frame buffer a second time, and state 526 clears the line of data in the frame buffer at the STRT Y address. Clearing the line of data requires setting bits in the frame buffer to a known state, such as a defined background color for the window being cleared, as discussed above. State 528 then sends signal 416 to increment the CNT Y register 408, it sends the signal 418 to decrement the LEN Y register 406, and it also sends signal 420 to increment the CNT Y register 408. If the LEN Y register has reached zero, the state machine exits. If the LEN Y register contains a value greater than zero, state 528 goes back to state 518.

State 518 accomplishes two things. First, it waits until the line counter is greater than the CNT Y address before returning to state 520. By doing this, it makes sure that the buffer clear operation follows the scanning beam.

State 518 also performs a second function, which is necessary when the beam approaches the bottom of the screen. If the beam reaches the bottom of the screen and a vertical retrace occurs, the line counter 402 (FIG. 4) will be cleared, that is, set to a value of zero. After the line counter is cleared, the CNT Y register 408 will not be less than the line counter until the beam scans all the way down the screen a second time. Since this would cause delay, and since there is no longer a need to follow the beam once the beam starts a vertical retrace, state 518 detects that a vertical blank signal has occurred and transfers to state 506 to complete the rest of the clear operation by ignoring the beam.

The vertical retrace situation can also occur when in state 516, so it will also transfer to state 506 if a vertical retrace occurs.

Those skilled in the art will recognize that line counter 402 could be implemented such that it is reset when the first line of data is scanned from the frame buffer 306, thus allowing the STRT Y and CNT Y registers to be combined. They will also recognize that tolerance values could make the U BUFFER register unnecessary.

The flag described above with respect to states 502 and states 504 solves a problem that can occur when very small windows are cleared. If a very small window exists on the screen, the clear operation will be performed very quickly. Once the clear operation is complete, the graphics device driver 120 (FIG. 1) is notified that the clear is complete and the application program may then place another graphic in this very small window. Again, since the window is very small, the time necessary to put the graphic in the window will also be very small. Once the graphic has been placed in the window after being cleared, the application program may choose to clear the window a second time. All three of these operations, the first clear, the display of the graphic, and the second clear, may occur during one display of the contents of the frame buffer on the screen. This situation can also occur with a double buffer swap. The result is the graphic displayed between the two clear operations would never be seen. This behavior may be desirable or undesirable, depending upon the application. Thus, the flag bit is programmable to be disabled or enabled, as described below.

The flag bit solves this problem by preventing a second clear until the flag bit is cleared by a vertical retrace. That is, state 502 will only proceed if the flag is zero. State 504 sets the flag to a one, and the flag is set back to a zero by the vertical blank signal 312. Thus, a second clear will not be allowed until after a vertical retrace has occurred. Flag register 414 is shown in FIG. 4, along with the set and clear signals.

The flag register 414 can be programmed to perform the wait or programmed to ignore the wait by clearing the FLAG ENABLE register 424. If FLAG ENABLE 424 is cleared to a zero value, FLAG register 414 cannot be set by the state machine, so it will always be zero and the wait will be disabled.

Having thus described a presently preferred embodiment of the present invention, it will now be appreciated that the aspects of the invention have been fully achieved, and it will be understood by those skilled in the art that many changes in construction and circuitry and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. A circuit for clearing an area of data in a frame buffer connected to a CRT, in synchronization with an electron beam scanning said CRT, wherein said CRT displays data from said frame buffer in synchronization with said electron beam, said circuit comprising:

a start register for storing a value representing an address of a first line of data in said area, wherein said value is stored into said start register by external circuitry when said clearing is initiated;

a length register for storing a value representing a number of lines of data in said area, wherein said value is stored into said length register by external circuitry when said clearing is initiated;

a beam count register for storing a value representing an address of a line of frame buffer data being scanned by said electron beam, said beam count register being connected to said CRT to cause said value to be incremented each time said electron beam scans a line of data from said frame buffer, and said beam count register being connected to said CRT to cause said value to be set to zero each time said electron beam starts scanning from a beginning of said frame buffer to display data at a top of said CRT;

state machine means connected to said start register, said length register, said beam count register, said electron beam, and said frame buffer, for comparing a value in said start register to a value in said beam count register, for clearing a line of data in said frame buffer area at an address represented by said value contained within said start register when a value in said start register is less than a value in said beam count register, for incrementing said start register value after said line is cleared, for decrementing said length register value after said line is cleared, and for terminating said clearing when said length register has a value of zero.

2. The circuit of claim 1 wherein said state machine means further comprises means for continuously clearing lines of said frame buffer, without comparing said start register to said beam count register, after said electron beam starts a vertical retrace operation.

3. The circuit of claim 1 further comprising a flag register connected to said CRT and connected to said state machine, wherein said electron beam clears said flag register when said electron beam starts scanning from said beginning of said frame buffer to display data at a top of said CRT, wherein said state machine means sets said flag register before clearing a first line of data in said frame buffer, and wherein said state machine will not start said clearing while said flag register is set.

4. The circuit of claim 3 further comprising blocking means, connected to said flag register, for causing said state machine to disregard said flag register, wherein said blocking means is enabled or disabled by external circuitry before said clearing is initiated.

5. The circuit of claim 1 further comprising a guard register, connected to said state machine, for storing a value representing an address in said frame buffer, wherein said value is set into said guard register by external circuitry when said clearing is initiated, and wherein said state machine means further comprises means for continuously clearing lines of said frame buffer, without comparing said start register to said beam count register, when said beam count register value is less than said guard register value when said clearing is initiated.

6. A circuit for clearing an area of data in a frame buffer connected to a CRT, in synchronization with an electron beam scanning said CRT, wherein said CRT displays data from said frame buffer in synchronization with said electron beam, said circuit comprising:

a start register for storing a value representing an address of a first line of data in said area, wherein said value is stored into said start register by external circuitry when said clearing is initiated;

a length register for storing a value representing a number of lines of data in said area, wherein said value is stored into said length register by external circuitry when said clearing is initiated;

a beam count register for storing a value representing an address of a line being scanned by said electron beam, said beam count register being connected to said CRT to cause said value to be incremented each time said electron beam scans a line of said CRT, and said beam count register being connected to said CRT to cause said value to be set to zero each time said electron beam starts a vertical retrace operation on said CRT;

a line count register for storing a value representing a number of scan lines scanned by said electron beam between a start of said vertical retrace operation and scanning of a first line of data in said area, wherein said value is stored into said line count register by external circuitry when said clearing is initiated;

state machine means connected to said start register, said length register, said beam count register, said line count register, and said frame buffer, for comparing a value in said line count register to a value in said beam count register, for clearing a line of data in said frame buffer area at an address represented by said value contained within said start register when a value in said line count register is less than a value in said beam count register, for incrementing said start register value after said line is cleared, for incrementing said line count register value after said line is cleared, for decrementing said length register value after said line is cleared, and for terminating said clearing when said length register has a value of zero.

7. The circuit of claim 6 wherein said state machine means further comprises means for continuously clearing lines of said frame buffer, without comparing said line count register to said beam count register, after said electron beam starts said vertical retrace operation.

8. The circuit of claim 6 further comprising a flag register connected to said CRT and connected to said state machine, wherein said flag register is cleared by said vertical retrace operation, wherein said state machine means sets said flag register before clearing a first line of data in said frame buffer, and wherein said state machine will not start said clearing while said flag register is set.

9. The circuit of claim 8 further comprising blocking means, connected to said flag register, for causing said state machine to disregard said flag register, wherein said blocking means is enabled or disabled by external circuitry before said clearing is initiated.

10. The circuit of claim 6 further comprising a guard register, connected to said state machine, for storing a value representing an address in said frame buffer, wherein said value is set into said guard register by external circuitry when said clearing is initiated, and wherein said state machine means further comprises means for continuously clearing lines of said frame buffer, without comparing said line count register to said beam count register, when said beam count register value is less than said guard register value when said clearing is initiated.

11. A method for clearing an area of data in a frame buffer connected to a CRT, in synchronization with an electron beam scanning said CRT, wherein said CRT displays data from said frame buffer in synchronization with said electron beam, said method comprising:

(a) receiving a start value representing an address of a first line of data in said area;

(b) receiving a length value representing a number of lines of data in said area;

(c) receiving a line count value representing a number of scan lines between a start of a vertical retrace operation and a first line of data in said area;

(d) incrementing a beam count value each time said electron beam scans a line on said CRT, wherein said beam count value is set to zero each time said electron beam starts a vertical retrace operation on said CRT;

(e) comparing said line count value to said beam count value and repeating steps (d) and (e) if said line count value is not less than said beam count value;

(f) clearing a line of data in said frame buffer area at an address represented by said start value;

(g) incrementing said start value;

(h) incrementing said line count value;

(i) decrementing said length value; and (j) repeating steps (d) through (i) until said length value is zero.

12. The method of claim 11 wherein step (j) further comprises the step of:

(j1) after a vertical retrace operation is started, repeating steps (f) through (i) until said length value is zero.

13. The method of claim 11 wherein the following step (c1) is performed after step (c) and before step (d):

(c1) when the following steps (d) through (j) have been performed since a last vertical retrace operation has occurred, waiting until a subsequent vertical retrace operation occurs before proceeding with step (d).

14. The method of claim 1 wherein the following steps (c1) through (c3) are performed after step (c) and before step (d):

(c1) receiving a flag enable value;

(c2) if said flag enable value is zero, proceeding with step (d); and (c3) when the flag enable value is not zero and the following steps (d) through (j) have been performed since a last vertical retrace operation has occurred, waiting until a subsequent vertical retrace operation occurs before proceeding with step (d).

15. The method of claim 11 wherein step (d) further comprises the following step (d1) and wherein step (j) is replaced by the following step (j1):

(d1) receiving a guard value, comparing said guard value to said beam count value, and if said beam count value is less than said guard value, setting a guard flag to a first predetermined value and proceeding with step (f), and if said beam count value is not less than said guard value, setting said guard flag to a second predetermined value and proceeding with step (e); and (j1) if said guard flag is set to said first predetermined value, repeating steps (f) through (i) until said length value is zero, and if said guard flag is set to said second predetermined value, repeating steps (d) through (i) until said length value is zero.

* * * * *